US005107590A

United States Patent [19]

Burout, III et al.

[11] Patent Number: 5,107,590

[45] Date of Patent: Apr. 28, 1992

[54] RAZOR HANDLE

[75] Inventors: Charles J. Burout, III, Oxford; Frank A. Ferraro, Trumball; Evan N. Chen, Fairfield, all of Conn.

[73] Assignee: Warner-Lambert Company, Morris Plains, N.J.

[21] Appl. No.: 675,988

[22] Filed: Mar. 26, 1991

[51] Int. Cl.[5] ..... B26B 21/30

[52] U.S. Cl. ..... 30/85; 30/47

[58] Field of Search ..... 30/85-90, 30/32, 47-50, 329, 340; 16/110 R, DIG. 12, DIG. 19

[56] References Cited

U.S. PATENT DOCUMENTS 3,358,368 12/1967 Kuhnl .
3,374,540 3/1968 De Louguyon .
3,435,521 4/1969 Kuhnl ..... 30/85 X
3,918,155 11/1975 Atkins ..... 30/47
4,949,457 8/1990 Burout ..... 30/85

FOREIGN PATENT DOCUMENTS 133873 10/1919 United Kingdom .

*Primary Examiner*—Douglas D. Watts
*Attorney, Agent, or Firm*—Richard S. Bullitt

[57] ABSTRACT

A razor handle having a rigid core, and preferably a moldable resilient cover, adapted for attachment to a separately formed handle head. The rigid core of the razor handle in the present invention advantageously extends upwardly into the handle head. According to one preferred embodiment of the present invention, the rigid core is formed, at least in part, of a metal. The covering layer, because of its flexibility, compressibility and initial deformability, provides a comfortable secure surface for the razor user. The resilient cover provides a limit for compressibility as well as a compressive resilience desired by many users.

7 Claims, 3 Drawing Sheets

RAZOR HANDLE

BACKGROUND OF THE INVENTION

The present invention is directed to a handle for a razor and, more particularly, to a razor handle having a rigid support which extends into a handle head.

Wet shaving razors of the disposable and cartridge types are often made of an injection molded plastic material such as polystyrene. Such plastics are easy to work with during manufacturing, relatively inexpensive and durable. The handle portion of the razor is generally textured in some manner to provide a gripping surface for the user. This is particularly desirable because of the slipperiness imparted to the handle during the act of shaving resulting from the contact of the handle with soap and water.

A multi-component razor handle having a rigid inner core covered by a moldable, compressible resilient covering layer is disclosed in U.S. Pat. No. 4,949,457 to Burout, III which provides a textured feel desired by many users.

On disadvantage inherent in the use of plastics is the materials strength. While the strength of plastic is more than adequate during normal use, razors are subject to a certain amount of misuse by the consuming public. For example, if a consumer grasps the bottom of a razor handle, places the handle head on a fixed surface and exerts undue pressure, a conventional totally plastic razor handle and handle head may fracture at the juncture of the razor handle and handle head. It would therefore be desirable to provide a razor handle, and a razor comprising a combination of a razor handle and a handle head having greater strength and resistance to breakage.

It has now been found to be desirable to extend the rigid core of a razor handle into the handle head in order to provide a more secure attachment between the handle and the handle head which are occasionally subject to misuse.

SUMMARY OF THE INVENTION

The present invention comprises a composite razor handle having a rigid inner core, and preferably a moldable resilient covering layer, adapted for attachment to a separately formed handle head. The rigid inner core of the razor handle in the present invention advantageously extends upwardly into the discrete handle head. According to one preferred embodiment of the present invention, the rigid inner core is formed, at least in part, of a metal. The covering layer, because of its flexibility, compressibility and initial deformability, provides a comfortable secure surface for the razor user. The handle of this invention, due to its biocomponent nature, provides a limit for compressibility as well as a compressive resilience desired by many users.

DETAILED DESCRIPTION OF THE INVENTION

Figure 1:
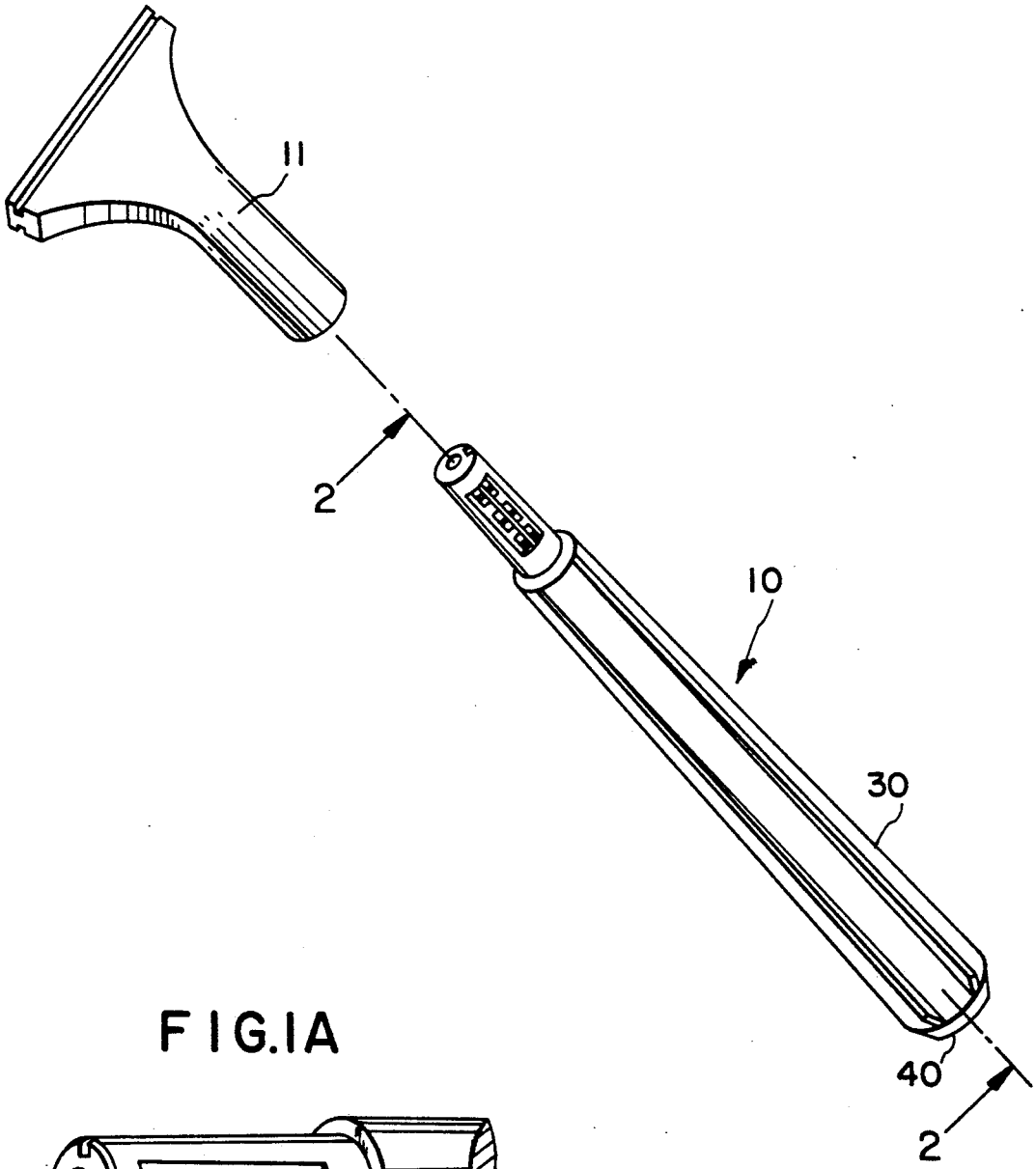
FIG. 1 is a partially-exploded, perspective view of a razor handle and a handle head of the present invention.
Figure 1A:
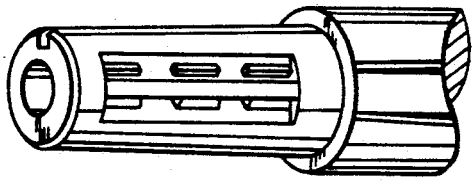
FIG. 1A is a perspective, enlarged view of the distal end of the razor handle illustrated in FIG. 1.

According to the illustrated embodiment of the present invention, the razor handle 10 comprises a rigid inner core member 20 whose sides are substantially encased in a resilient cover 30, an end cap 40 and a weight 50 disposed within a hollow section of core 20. The razor handle 10 is particularly adapted to be secured to a separately formed handle head 11, illustrated in FIG. 1. While the illustrated embodiment of the present invention is designed to be connected to a handle head 11 which is designed to support a separate blade cartridge, the razor handle of the present invention may also be utilized with a handle head having one or more blades permanently affixed thereto, as in a disposable razor. While handle head 11 has been illustrated with a conventional rail type attachment, adapted for engagement with a disposable cartridge, other forms of attachment members may be utilized. The specific form of attachment member does not form a part of the present invention.

Figure 3:
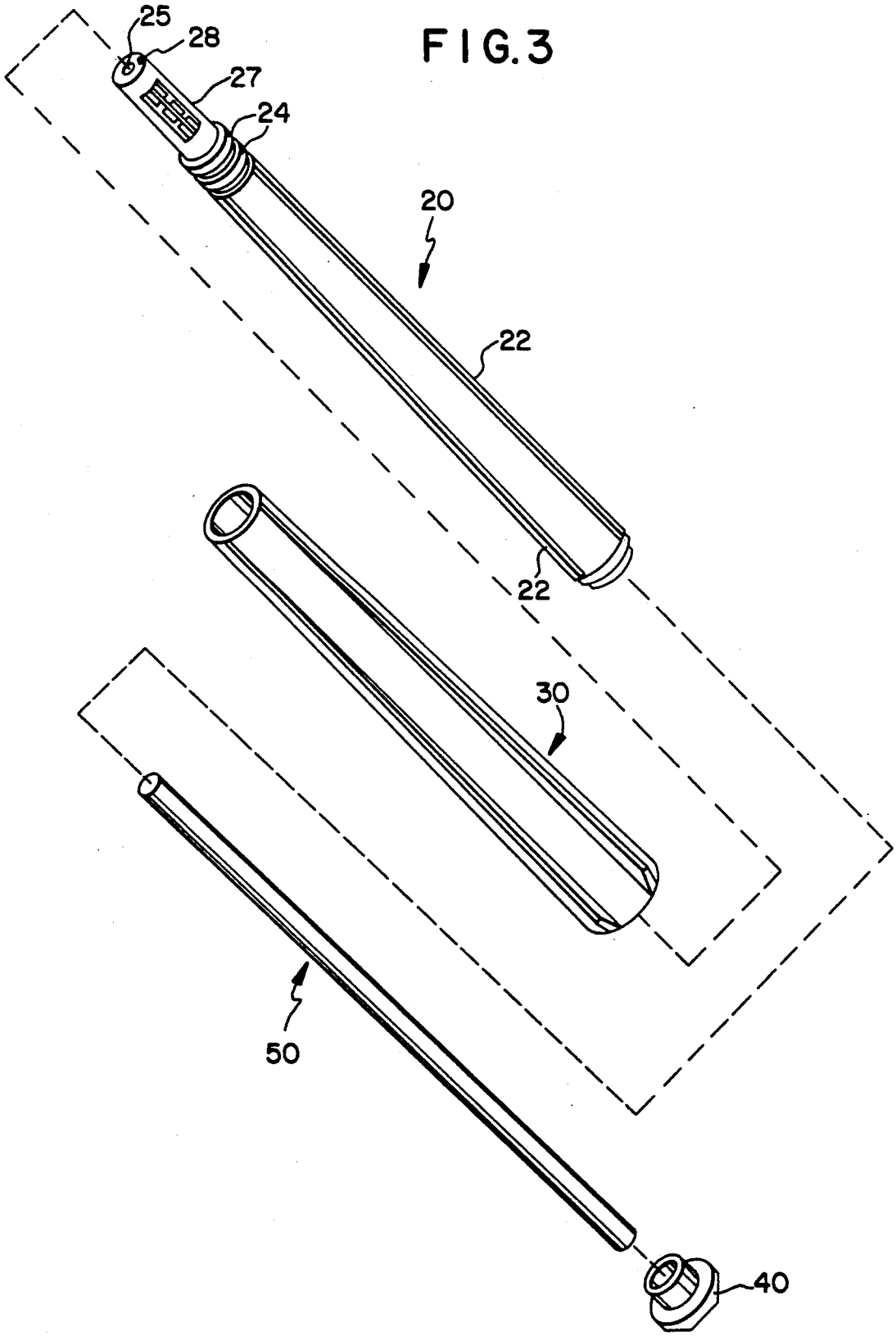
FIG. 3 is an exploded, perspective view of the razor handle shown in FIG. 1.

The four pieces of the illustrated handle 10 are shown separately in the exploded view of FIG. 3. The outer surface of rigid core 20 advantageously comprises a number of longitudinal slots 22, radially disposed protrusions 24, and attachment ribs 27. Both the radial protrusions 24 and longitudinal ribs 22 are designed to prevent relative slippage between rigid core 20 and resilient cover 30. The radial protrusions 24 also anchor the cover 30 to the core 20 to prevent the cover 30 from peeling back from the distal end of the core 20. The longitudinal ribs 27 on core 20 are particularly adapted to provide a secure connection between razor handle 10 and handle head 11. The distal end of core 20 is also advantageously provided with an alignment slot 28 in order to provide a more secure connection with handle head 11 as shown in FIG. 1.

A bore 25 extends through the center of rigid core 20 providing space for a cylindrical weight 50. Bore 25 is advantageously designed to provide an interference fit for at least a portion of cylindrical weight 50 such that the weight will not rattle and shift within the handle during use. The weight provides a more substantive feel to the handle and ensures that the center of gravity of the entire razor is within the handle during shaving. While weight 50 may be secured within rigid core 20 in any suitable manner, such as through the use of an adhesive, assembly is facilitated by simply sizing at least a portion of bore 25 such that an interference fit will result when weight 50 is inserted into bore 25. It will be appreciated from the figures that weight 50 is inserted into the bottom of rigid core 20 prior to sealing the bottom of handle 10 with end cap 40. Weight 50 may be formed of any suitable material, but preferably comprises at least one metal such as steel, lead, brass, etc. which are relatively inexpensive and have sufficient mass to provide a solid feel to a razor handle of the present invention. Those skilled in the art will appreciate that the rigid core may be designed for insertion of the weight through the top of the core without departing from the scope of the present invention. As discussed in further detail below, by extending weight into the distal, uncovered end of rigid core 20, greater strength is provided to the connection between razor handle 10 and handle head 11.

Core 20 may be formed of any rigid material. For ease of manufacturing and cost efficiency, core 20 is preferably formed of a rigid thermoplastic material which can easily be molded, for example, by injection molding.

Figure 2:
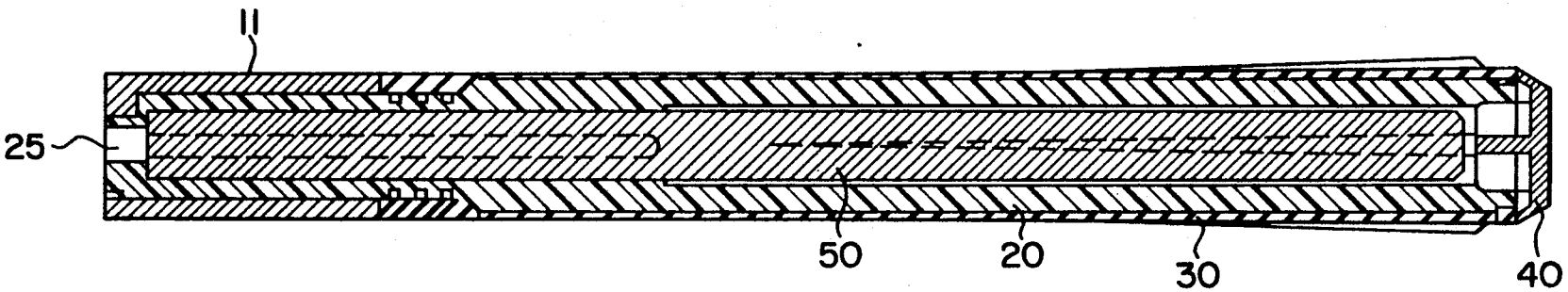
FIG. 2 is a partial cross-sectional side view taken along lines 2—2 of FIG. 1.

As shown in FIG. 2, the rigid core 20 and weight 50 are designed to extend into the proximal end of handle head 11. By extending the rigid core 20 and weight 50 into handle head 11, a stronger connection is provided between these two pieces and there is less likelihood of breakage. As with many consumer products, razors are subject to a certain amount of misuse by the consuming public. The present invention advantageously provides greater strength, safety and support to the handle head which may be subjected to abnormal forces when misused.

Figure 4:
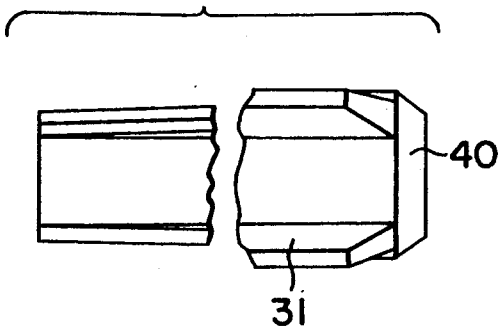
FIG. 4 is a sectional, perspective view of the bottom portion of the razor handle shown in FIG. 1.

Though not necessary for the present invention, substantially encasing most of rigid core 20 of the illustrated embodiment is a resilient cover 30. Resilient cover 30 fits securely around core 20 including longitudinal ribs 22 and radial protrusions 24. As shown in FIG. 2, cover 30 is tapered near the bottom of razor handle 10 exposing a small section of rigid core 20. In this manner, resilient cover 30 does not interfere with the placement of an end cap 40 in order to close the bottom of core 20 and thereby prevent water, soap and other shaving debris from entering the interior of handle 10. Cover 30 is preferably formed with plurality of outwardly extending longitudinal ribs 31, best illustrated in FIG. 4, which advantageously provide a secure gripping surface for the user.

Those skilled in the art will appreciate that outer cover 30 should be formed of a water-resistant material having a relatively high coefficient of friction in order to prevent slippage of the razor handle during shaving.

According to a preferred embodiment of the present invention, both the core 20 and the cover 30 are made of moldable material. These materials should be compatible to the extent that the underlying thermoplastic core material maintains structural integrity while the moldable covering layer is formed around it. Thus, the choice of the resilient covering material may affect the choice of core material because of the desire for compatible operating conditions during molding. A suitable, and presently preferred combination employs an acrylonitrile butadiene styrene (ABS) co-polymer, such as Cyrolac DFA R-4500 manufactured by Borg Warner of Chicago, Ill., in combination with a covering layer material which is a thermoplastic rubber such as Santoprene 201-64 sold by Monsanto Inc., St. Louis, Mo.

A currently preferred method of manufacture of the handles is by an insert molding process wherein the cores are molded of the ABS polymer, ejected and placed into a second mold wherein the moldable thermoplastic rubber substantially encompasses the core as shown in FIG. 2.

An alternative method of manufacture is to complete the injection molding in a two step process in a single mold. In either instance, after the ABS core is formed it provides part of the male mold member.

It is desirable that the cover 20 be both compressible and resilient so that after repeated compressions the handle loses no more than 20% of its circumferential area at the point of the compressions and preferably less than about 5%. Those skilled in the art will appreciate that this measurement is known as the compressive set.

It is also preferred that the handle cover have a thickness of about 0.025–1.5 inches thus allowing for ample compression resilience and security of grip by the user. The covering layer can be further defined as having a durometer value of about 55 Shore A–50 Shore D hardness and preferably about 55–80 Shore A.

The handle produced according to the preferred embodiment of this invention is soft, aesthetically pleasing, resilient and easy to use during a wet shaving operation.

It should be noted that the handle as defined for purposes of this invention is the gripping portion of either a disposable razor or a cartridge razor. Methods of attaching a cartridge to a cartridge razor are well known in the art and do not form part of this invention.

What is claimed is:

1. A composite razor handle for use with a handle head comprising:

(a) a rigid inner core comprising a gripping section, a bore extending along a longitudinal axis of said core, and an attachment section, wherein said attachment section is adapted to extend into said handle head and wherein said bore is substantially filled with a weight that extends into said attachment section; and (b) a moldable, compressible, resilient cover substantially enveloping said gripping section.

2. The composite razor handle of claim 1, wherein said weight comprises a metal.

3. The composite razor handle of claim 1, wherein said core comprises an acrylonitrile butadiene styrene copolymer.

4. The razor handle of claim 1, wherein said cover comprises thermoplastic rubber.

5. The razor handle of claim 1, wherein the compressive set of said cover is less than 20%.

6. The razor handle of claim 5, wherein the compressive set of said cover is less than 5%.

7. The razor handle of claim 1, wherein said cover has a durometer value from about 55 Shore A to about 50 Shore D hardness.

* * * * *